United States Patent [19]

Tenconi

[11] Patent Number: 4,887,439

[45] Date of Patent: Dec. 19, 1989

[54] PROCESS FOR MANUFACTURING A SEMI-FINISHED ITEM FOR THE PRODUCTION OF BRIEFS WITH A CIRCULAR KNITTING MACHINE

[75] Inventor: Riccardo Tenconi, Varese, Italy

[73] Assignee: MEC-MOR S.p.A., Induno Olona, Italy

[21] Appl. No.: 190,964

[22] Filed: May 6, 1988

[30] Foreign Application Priority Data

May 18, 1987 [IT] Italy ..... 20573 A/87

[51] Int. Cl.[4] ..... A41B 9/00

[52] U.S. Cl. ..... 66/51; 66/172 E; 66/176

[58] Field of Search ..... 2/401; 66/51, 172 E, 66/175, 176, 177

[56] References Cited

U.S. PATENT DOCUMENTS

| | | | |
|---|---|---|---|
| 3,625,029 | 12/1971 | Saprit et al. | 66/172 E |
| 3,981,161 | 9/1976 | Conti et al. | 66/177 |
| 4,010,627 | 3/1977 | Pernick | 66/177 |
| 4,022,035 | 5/1977 | Lonati | 66/177 |
| 4,023,384 | 5/1977 | Conti et al. | 66/172 E |
| 4,682,479 | 7/1987 | Pernick | 66/176 |

FOREIGN PATENT DOCUMENTS

| | | | |
|---|---|---|---|
| 2303469 | 8/1974 | Fed. Rep. of Germany | 66/172 E |
| 2431838 | 1/1975 | Fed. Rep. of Germany | 66/177 |
| 468496 | 3/1969 | Switzerland | 66/172 E |
| 2076634 | 12/1981 | United Kingdom | 66/172 E |

*Primary Examiner*—Wm. Carter Reynolds

*Attorney, Agent, or Firm*—Guido Modiano; Albert Josif

[57] ABSTRACT

The process has: a first step of formation of an elastic border, a second step of formation of a tubular body of knitting starting from the elastic border for a preset number of complete rows, a third step in which a first group of needles and a second group of needles of the machine, which operate on mutually angularly spaced portions of the tubular body, are excluded from working to define a pair of missing portions which constitute the leg apertures of the briefs; the needles excluded from working gradually increase in number for a widening of the missing portions. In the second step, during the knitting of the last complete rows of the tubular body, a preset number of needles, which operate in the mutually angularly spaced regions, and, in the third step, a preset number of needles proximate to the first group and to the second group of needles, are fed with yarn and with elastic thread for the formation of an elastic border around the leg apertures.

4 Claims, 2 Drawing Sheets

PROCESS FOR MANUFACTURING A SEMI-FINISHED ITEM FOR THE PRODUCTION OF BRIEFS WITH A CIRCULAR KNITTING MACHINE

BACKGROUND OF THE INVENTION

The present invention relates to a process for manufacturing a semi-finished item for the production of briefs with a circular knitting machine for knitwear, stockings and the like.

As is known, men's or women's briefs are currently generally manufactured with portions of knitting cut to size which are sewn together at the hips and possibly at the crotch region. Briefs are also subject to a finishing operation which consists of the application, by sewing, of an elastic border at the leg apertures and in the upper part intended to girdle the hips of the user.

Processes are furthermore known for the execution of semi-finished items which are manufactured with circular knitting machines for knitwear and stockings and are subsequently subject to finishing operations for the obtainment of briefs.

One of these processes, described in the U.S. Pat. No. 4,010,627, substantially consists of the execution of an elastic border intended to girdle the user proximate to the hips and, subsequently, all of the needles of the machine are carried to a working position in the knitting process to execute a tubular body with complete rows of knitting. At the end of the second step, two groups of needles which operate on two mutually angularly spaced portions of the tubular body are excluded from working and the number of needles in the two groups gradually increases so as to define, on the lateral surface of the tubular body, a pair of missing portions which gradually widen and constitute the leg apertures of the briefs to be manufactured. Once the knitting is terminated, the needles are disengaged from the last loops of knitting which they have formed and an elastic border is applied to the semi-finished item at the leg apertures. Subsequently, the briefs are completed by superimposing and mutually sewing the two flaps of the tubular body which are opposite to the elastic border formed by the machine.

This process, though it allows to obtain briefs without lateral sewings and avoids the application of the elastic border intended to girdle the hips of the user, requires in any case sewing operations for the application of the elastic border at the leg apertures. Such sewing operations must be executed with particular machines and increase the production time of the finished article, severely affecting its production cost.

SUMMARY OF THE INVENTION

The aim of the present invention is to obviate this disadvantage by providing a process which allows the manufacture of a semi-finished item for the production of briefs with a circular knitting machine for knitwear and stockings, which requires no further sewing operations for the application of elastic borders at the leg apertures.

Within this aim, an object of the invention is to provide a process which can be simply executed on known circular knitting machines for knitwear or stockings.

This aim, as well as this and other objects which will become apparent hereinafter, are achieved by a process for manufacturing a semi-finished item for the production of briefs with a circular knitting machine for knitwear, stockings or the like, comprising: a first step of formation of an elastic border intended to girdle the user proximate to the hips, a second step of formation of a tubular body of knitting starting from said elastic border for a preset number of complete rows, a third step in which a first group of needles and a second group of needles of the machine, operating on mutually angularly spaced portions of said tubular body, are excluded from working to define, on the lateral surface of said tubular body, a pair of missing portions constituting the leg apertures of the briefs, said first group of needles and said second group of needles excluded from working gradually increasing in number for a widening of said missing portions, and a fourth step of disengagement of the needles from the loops of said tubular body, characterized in that, in said second step, in the knitting of the last complete rows of said tubular body, a preset number of needles, operating in said mutually angularly spaced regions, is fed with yarn and with elastic thread and in that, in said third step, a preset number of needles, proximate to said first group and to said second group of needles, is fed with yarn and with elastic thread for the formation of an elastic border around said leg apertures.

BRIEF DESCRIPTION OF THE DRAWINGS

Further characteristics and advantges of the invention will become apparent from the detailed description of two preferred but not exclusive embodiments of the process according to the invention, illustrated only by way of non-limitative example in the accompanying drawings, wherein.

DESCRIPTION OF THE PREFERRED EMBODIMENTS

Figure 3:
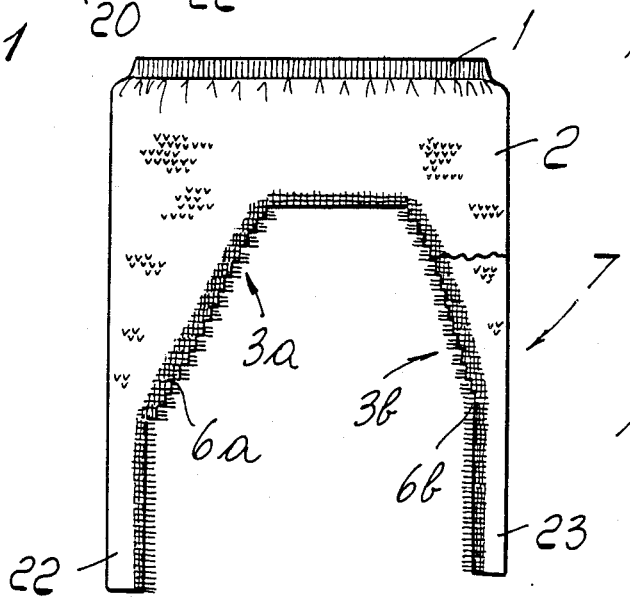
FIG. 3 is a lateral elevation view of a semi-finished item produced with the process according to the invention in a first embodiment.
Figure 4:
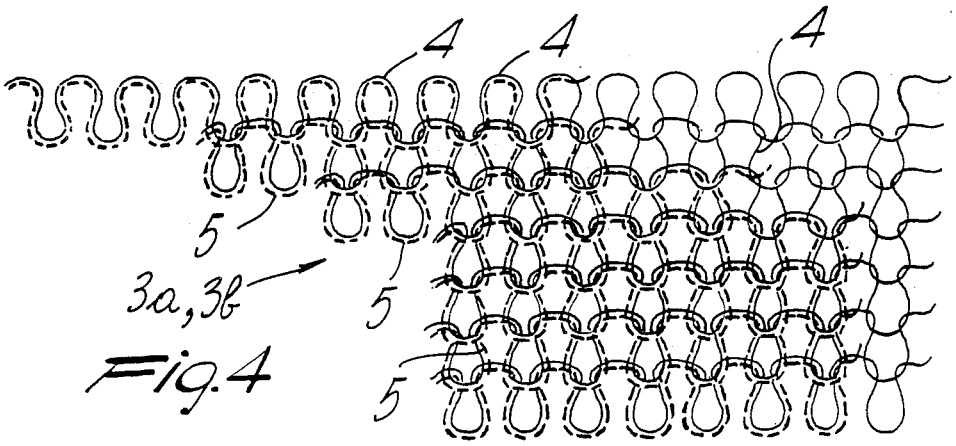
FIG. 4 is an enlarged detail view of FIG. 3, pointing out the knitting at a leg aperture.

With particular reference to FIGS. 3 and 4, the process according to the invention substantially consists of a first step in which an elastic border 1 intended to girdle the hips of the user is executed, of a second step in which a tubular body 2 of knitting is executed starting from the elastic border 1 for a preset number of complete rows, of a third step in which a first group of needles and a second group of needles of the machine, which operate on mutually angularly spaced portions of the tubular body, are excluded from working so as to define on the lateral surface of the tubular body 2 a pair of missing portions 3*a* and 3*b* which constitute the leg apertures of the briefs. The number of needles of the first and of the second group gradually increases so as to obtain a gradual widening of the leg apertures in an opposite direction to the elastic border 1.

The elastic border 1 can be manufactured in a known manner similar to the elastic border of stocking-pants or stockings, i.e. so that it is folded on itself to assume a flattened tubular configuration.

For the execution of the second step of the process, i.e. for the production of the tubular body 2, the machine is actuated in a known manner as for the execution of tubular portions of socks, stockings or knitwear.

According to the invention, in the second step of the process, in the execution of the last complete rows of knitting of the tubular body 2 a preset number of needles of the machine which operate on the mutually angularly spaced portions of the tubular body 2, i.e. proximate to the upper border of the missing portions 3*a* and 3*b*, is fed with yarn 4 and with elastic thread 5; furthermore, in the third step of the process, a preset number of needles of the machine, proximate to the needles of the first and of the second group which are excluded from working, is also fed with yarn 4 and with elastic thread 5. In this manner one obtains the border of the missing portions 3*a* and 3*b* constituted by an elastic border 6*a* and 6*b*.

In the first embodiment of the process according to the invention, a circular knitting machine can be used which is actuated, in a known manner, with continuous rotary motion, i.e. with a continuous rotary motion of the needle cylinder relatively to one or more feeds to which the yarn 4 and the elastic thread 5 are fed. In this case, after the yarn 4 and the elastic thread 5 have been fed to the needles which will subsequently be excluded from working, both the yarn 4 and the elastic thread 5 are cut at the border of the aperture and are subsequently fed to the needles which knit the opposite border. Once the knitting of the opposite border is complete, the elastic thread 5 is cut again. Obviously it would be possible to maintain the yarn 4 and/or the elastic thread 5 floating between the counterposed borders of the missing portions 3*a* and 3*b* and to provide a successive cutting operation on the semi-finished item 7 which is obtained, indeed to define the missing portions 3*a* and 3*b*.

Figure 5:
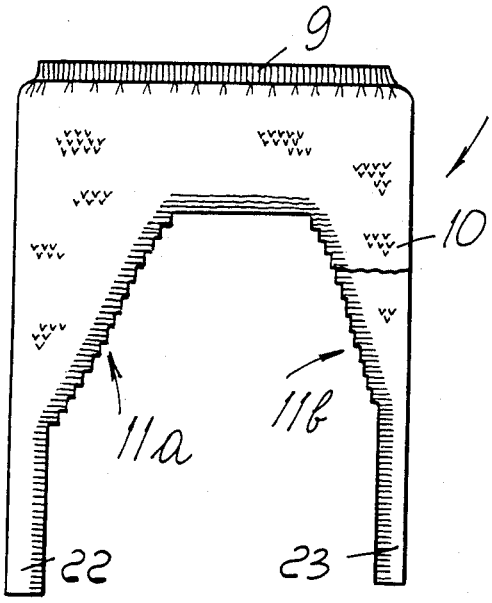
FIG. 5 is a lateral elevation view of a semi-finished item obtained with the process according to the invention in a second embodiment.
Figure 2A:
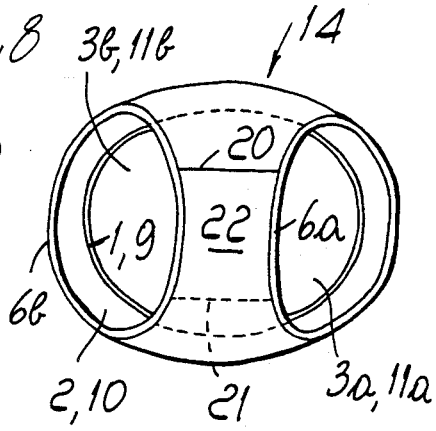
FIG. 2*a* is a bottom plan view of the briefs illustrated in FIG. 2.
Figure 6:
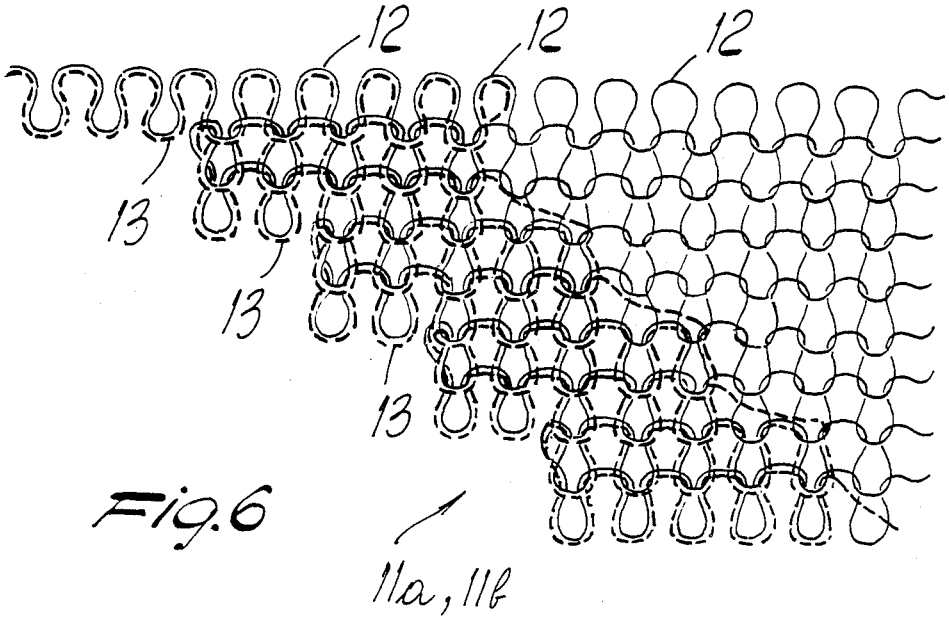
FIG. 6 is an enlarged detail view of FIG. 5 pointing out the knitting at a leg aperture.

In the second embodiment of the process according to the invention, a circular knitting machine is used which is actuated, in a known manner, with alternating rotary motion, i.e. with an alternating rotary motion of the needle cylinder relatively to the feeds to which the yarn and the elastic thread are fed. The semi-finished item 8 which is obtained with this second embodiment of the process is illustrated in particular in FIGS. 5 and 6 in which 9 indicates the elastic border intended to girdle the user proximate to the hips, 10 indicates the tubular body and 11*a* and 11*b* indicate the pair of missing portions which constitute the leg apertures of the briefs. In this case it is not necessary to perform the cutting of the yarn and of the elastic thread at the borders of the missing portions 11*a* and 11*b*, since the yarn and the elastic thread, respectively indicated by the numerals 12 and 13, during the outward motion, at the needles excluded from working, are recovered by the machine and again fed to the needles working during the return motion of the needle cylinder.

In this case it is necessary to provide two separate yarns for the execution of the two portions of the tubular body 10 which extend between the missing portions 11*a* and 11*b* and four separate elastic threads for the execution of the borders of said missing portions.

To avoid accidental ladders during knitting, possible due to the tensioning of the semi-finished item being formed both in the first embodiment and in the second embodiment, the last loop formed by a needle, which in the formation of the successive row of knitting is excluded from the knitting, is retained by the same needle until the end of the formation of the entire semi-finished item when all the loops are cast off the related needle and the finished semi-finished item is extracted from the machine.

Figure 1:
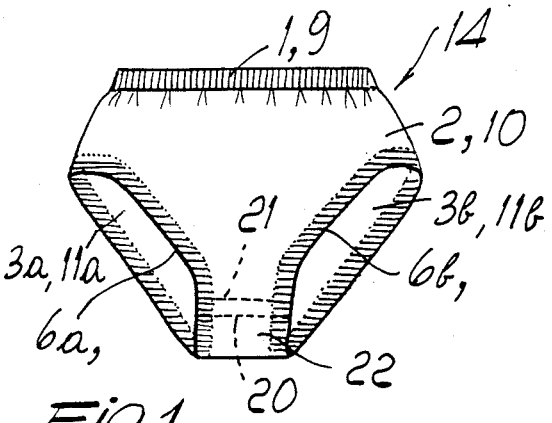
FIG. 1 is a front view of a pair of briefs obtained with a semi-finished item produced with the process according to the invention.
Figure 2:
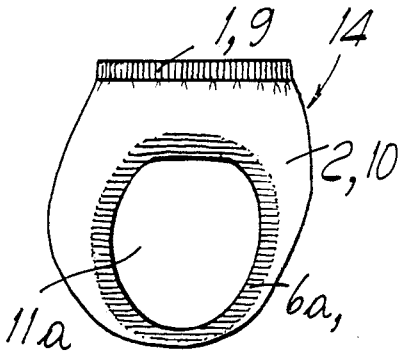
FIG. 2 is a lateral elevation view of the briefs obtained with a semi-finished item produced with the process according to the invention.

To provide a pair of briefs 14 of the type illustrated in FIGS. 1 and 2 it is sufficient to execute a pair of sewn seams 20,21, superimposing on one another the two flaps 22,23 of the tubular body 2 or 10 which are at the end of the tubular body opposite with respect to the elastic border 1 or 9.

Using scarcely slideable yarns, such as for example cotton, and also by virtue of the presence of the elastic thread which makes the knitting more finely meshed, it is possible to exclude with sufficient certainty the possibility of accidental ladders at the borders of the missing portions 3*a* and 3*b* or 11*a* and 11*b*. Furthermore, again at the border of these missing portions the knitting tends to fold on itself defining a small border which gives the briefs a more than acceptable degree of finishing.

In practice it has been observed that the process according to the invention fully achieves the intended aim since, by requiring no operations of sewing elastic borders along the leg apertures, it allows the manufacture of briefs with considerably reduced costs with respect to known processes.

Another advantage of the process according to the invention is that it can be simply executed on known types of circular knitting machines for knitwear or stockings.

The process thus conceived is susceptible to numerous modifications and variations, all of which are within the scope of the inventive concept; furthermore, all the details may be replaced with other technically equivalent elements. Thus, for example, during the formation of the tubular body 2 or 10 it is possible to perform, in a known manner, embroidery or designs according to the various requirements.

In practice, the materials employed, as well as the dimensions, may be any according to the requirements and the state of the art.

I claim:

1. Process for manufacturing a semi-finished item for the production of briefs with a circular knitting machine for knitwear, stockings and the like, comprising: a first step of formation of an elastic border intended to girdle the user proximate to the hips, a second step of formation of a tubular body of knitting starting from said elastic border for a present number of complete rows, a third step in which a first group of needles and a second group of needles of the machine, operating on mutually angularly spaced portions of said tubular body, are excluded from working to define, on the lateral surface of said tubular body, a pair of missing portions constituting the leg apertures of the briefs, said first group of needles and said second group of needles excluded from working gradually increasing in number for a widening of said missing portions and a fourth step of disengagement of the needles from the loops of said tubular body, wherein in said second step, in the knitting of the last complete rows of said tubular body, a preset number of needles, operating in said mutually angularly spaced regions, is fed with yarn and with elastic thread and wherein, in said third step, a preset number of needles, proximate to said first group and to said second group of needles, is fed with yarn and with elastic thread for the formation of an elastic border around said leg apertures.

2. Process, according to claim 1, wherein the machine is actuated with continuous rotary motion and wherein the yarn and the elastic thread are cut at the borders of said missing portions.

3. Process, according to claim 1, wherein the machine is actuated with alternating rotary motion and wherein each side of said elastic border is formed with a same elastic thread without discontinuities.

4. Process, according to claim 1, wherein the last loop formed by each needle subsequently excluded from the knitting is retained on said needle and cast off upon the completion of the knitting of said tubular body.

* * * * *